United States Patent [19]

Langseder et al.

[11] 4,361,251

[45] Nov. 30, 1982

[54] DETACHMENT RESISTANT RETAINED LEVER TAB

[75] Inventors: Neal Langseder, Rolling Meadows; Friedrich Stein, Wauconda, both of Ill.

[73] Assignee: American Can Company, Greenwich, Conn.

[21] Appl. No.: 264,411

[22] Filed: May 18, 1981

[51] Int. Cl.[3] ..... B65D 17/34

[52] U.S. Cl. ..... 220/269; 220/273

[58] Field of Search ..... 220/269–273

[56] References Cited

U.S. PATENT DOCUMENTS

| | | | |
|---|---|---|---|
| 3,977,561 | 8/1976 | Stroke et al. | 220/269 |
| 4,130,074 | 12/1978 | Cudzik | 113/121 R |
| 4,150,765 | 4/1979 | Mazurek | 220/269 |
| 4,210,257 | 7/1980 | Radtke | 220/273 |
| 4,211,335 | 7/1980 | Langseder | 220/269 |

*Primary Examiner*—George T. Hall

*Attorney, Agent, or Firm*—Paul R. Audet; Stuart S. Bowie; A. Passman

[57] ABSTRACT

A method of making a retained tab for a container end and a design for same are disclosed. The tab opens in such a way that multiple forms of stress are induced in the tab before the tab will break away from the end. Specifically, the tab endures first a bending stress and then a torsional stress. The mode of stress being defined by the construction of the tab.

8 Claims, 7 Drawing Figures

DETACHMENT RESISTANT RETAINED LEVER TAB

BACKGROUND OF THE INVENTION

The market for metal containers has developed widely in recent years due in part to the introduction of the easy open end. While the easy opening feature has been shown to be both effective and convenient, it has given rise to a collateral problem of littering, since traditionally the easy opening feature was pulled free from the container to expose the contents and then subsequently discarded. The indiscriminate disposal of the pull tabs is not only unsightly, but can also present a safety hazard particularly on beaches and in parks. Further, the relatively small size of the separated tab presents a challenge to those concerned with the collection and recycling of waste material. The solution to this problem resides in a nondetachable tab and preferably a tab which is compatible with the end closure and is recyclable.

While the industry has addressed this problem by developing a number of closure structures, one of the more successful has been a can end which employs a retained lever tab. In this structure, the tab is joined to the container end by a tongue or flap which is lanced in the web of the tab, and which serves as a hinge or connecting strip. Typically, the tip of the tongue is apertured and staked to end by means of an integral rivet. Since the tab functions by levering open a scored portion of the end panel, it must be sufficiently rigid to prevent distortion of the curled rim when leverage is applied to the lift end of the tab to effect rupture and displacement of the scored panel. At the same time, the tongue of the tab must be sufficiently bendable to permit the user to open the container and subsequently bend the tab back out of the way into a position of repose. The situation is aggravated by the user's inclination to fatigue the tab by bending it back and forth in an effort to free the tab from the container in accordance with past practice.

Typically, tab rigidity is provided by utilizing heavy aluminum tab stock and by curling the edges of the stock to form a tab rim. Such a structure, however, results in a tab tongue which lacks bendability and is prone to fracture when subjected to severe bending, as may be encountered when it is pivoted forward to open the end and then subsequently bent backward to fold the tab out of the way. Fracture of the tongue generally occurs between the terminal ends of the lance and the rivet hole or tongue aperture.

This lack of bendability of the tab tongue can be overcome in part by a more elaborate tab structure, wherein a retaining strip of plastic or ductile aluminum is interleafed into the folds of the tab nose, thereby providing a flexibility and fracture resistance linkage between the tab and the end. Such a structure requires a premium tie strip and appreciable press time for fabrication.

Alternative structures have been proposed using a soft ductile alloy for the tab, but with a more complex configuration as a means for achieving rigidity. In another instance, tin-plated steel has been suggested as a material of construction.

The problems of material recycling and raw edge corrosion or alternatively of increased manufacturing cost, which are attendent with these structures, are not readily resolved.

Typical of the prior art in connection with this type of invention are the Radtke U.S. Pat. No. 4,210,257 and the LangsederU.S. Pat. No. 4,211,335.

Accordingly, it is the primary objective of the instant invention to provide a lever tab structure for an easy open end which is sufficiently rigid to operate effectively without distorting, but where the tongue is sufficiently bendable so that it resists fracture and separation from the end despite repeated bending and rebending.

It is further an objective of the instant invention to provide a nondetachable tab structure which does not require a retaining strip and which is simple and economical to manufacture.

Finally, it is an objective of the instant invention to provide a tab structure which is compatible with the can end closure, thereby facilitating material recycling and minimizing corrosion.

SUMMARY OF THE INVENTION

It may be seen that the aforementioned objectives of the invention may be attained in an easy open end closure which comprises; a central panel wall with a peripheral flange, which is joined to the container and where the closure further includes an integral rivet and a displaceable panel located outward of the rivet, and which is substantially defined by a score line. In addition, the closure includes a lever tab for opening the end which is joined to the end panel by means of the rivet. The lever tab has a nose end, a lift end and a central web disposed therebetween. The web is lanced to form a tongue and the tongue is apertured to receive the rivet. A portion of the tongue is fully coined to be about 0.0125" thick. The part of the tongue between the rivet and the tab nose is triangular in plan view forming a triangle configured plane defined by coining. The coining, however, is not uniform across the triangle configured plane. That is to say that, the triangle configured plane is basically isosceles, and at the area adjacent one leg, the coining forms a precipice with a sharp fall off from the full thickness to where the metal is thinned by coining. Adjacent the other leg the coining is formed by a gradual slope at an angle of about 30° from the coined section to the uncoined section. This gradual slope of coined metal acts as a gusset to stiffen the tab in the area adjacent that leg of the triangle. Consequently, when the tab is bent the bending does not occur along the line at or parallel to the base of the triangle because of the asymmetry of the coining. The bending occurs near the base of the triangle on the side where there is coining to produce a sharp drop off. However, on the other side (with the gradual slope or gusset the bending occurs nearer the midpoint of the rivet. This discontinuous line of bending causes the tab to first fracture on the side where there is a gusset since the bending on that side is sharper. As the distance toward the rivet (away from the leg of the triangle) increases the sharpness of bend increases defining the point of first breakage. After that first side fractures, the remaining adjacent portion near the side with the coined sharp drop off begins to twist. Twisting is a new form of stress in the nature of torsional stress being less than the bending stress and allowing the tab to hold on longer.

It is preferable that the portion of the tongue, which is coined to a maximum depth, be in the form of a band or annulus which circumscribes the aperture, and include a triangle configured plane located outward of the band. These triangle configured planes may be so disposed as to give an asymmetric structure. The triangle configured plane is coined asymmetrically to cooperate to urge the tongue to bend and twist when the tab is pivoted forward to open the container and subsequently rebent to a position of repose.

Advantageously, the outward transitional plane toward the tip or apex of the triangle is inclined at an angle of between 4° and 8°, say 6½°, to the upper surface of the web. It is particularly preferable that the band be coined to provide a residual thickness of 0.0160"–0.010" say 0.0125".

Finally, it is advantageous to manufacture the tab by feeding a strip of tab stock into the progressive tab die of a press in which the following sequence of operations is carried out. The rivet aperture is punched in the strip which is then panelled to form the web of the tab with the aperture included in the web. The strip is sheared outward of the web to form a tab blank with a nose end and a lift end. The edges of the blank are wiped to curl the tab rim. The web of the tab is lanced to form a tongue with the aperture in the tongue tip and the tongue root formed proximate the tab nose. The tongue is displaced from the web plane by the lancing. The portion of the tongue proximate the root is reinserted into the web plane whereas the portion proximate the tip remains out of the web plane. The tab is struck to form the band of thinned metal circumscribing the aperture, and the unequal triangle configured planes of graduated coining. The curling of the rim is completed and the aperture repunched to the desired size and orientation.

DETAILED DESCRIPTION OF THE ILLUSTRATED EMBODIMENT

Figure 1:
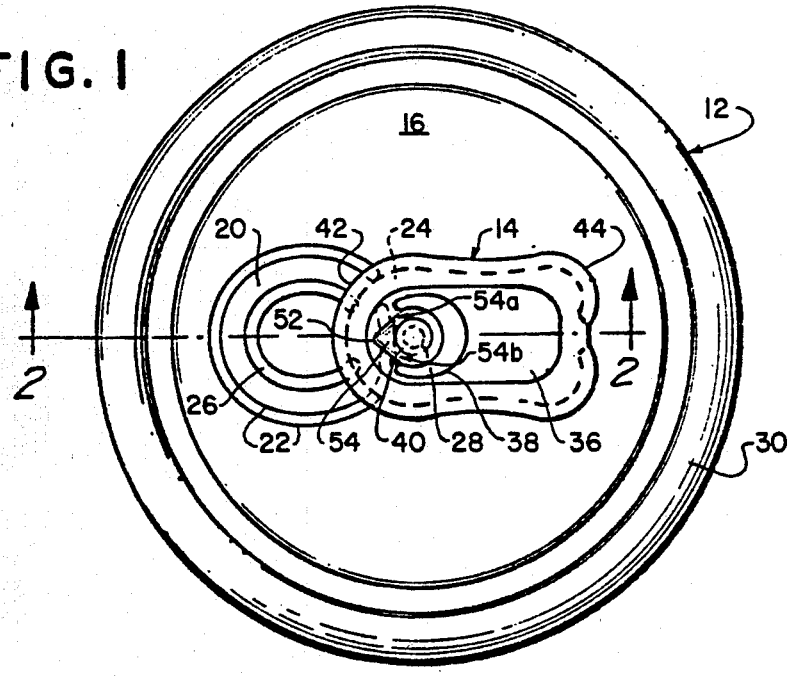
FIG. 1 is a plan view of an end closure embodying the present invention.
Figure 2:
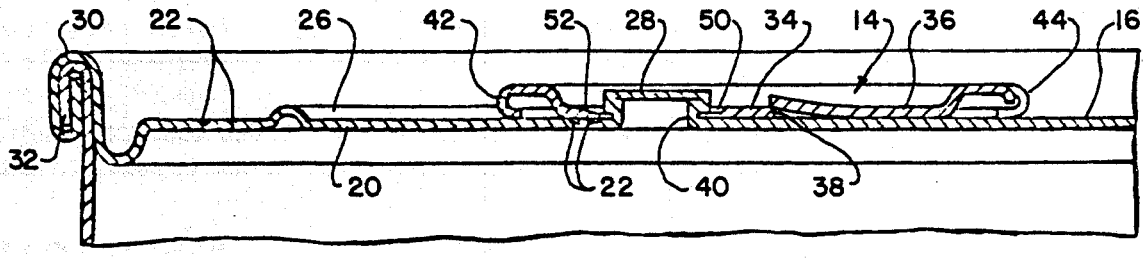
FIG. 2 is an enlarged fragmentary sectional view taken along the line 2—2 of FIG. 1.

Turning now in detail to FIGS. 1 and 2 of the appended drawings, therein illustrated is an easy open end closure with a nondetachable fracture resistant lever tab 14 embodying the present invention. The closure includes a central panel wall 16 with a displaceable pour panel 20 and the detachment resistant lever tab 14. The displaceable panel 20 is substantially defined by a continuous score line 22 with an unscored portion 24 lying between the extremities of the scoring. The unscored portion or neck serves as a hinge for the displaceable panel allowing it to remain attached to the panel wall even after opening. The displaceable pour panel is additionally provided with an upbead 26, which provides structural re-enforcement for the panel. The detachable resistant tab 14 is lever type opening device with an aperture 40 for staking to the central panel by means of rivet 28, which is an integral part of the panel wall preferably formed in accordance with the method of U.S. Pat. No. 3,361,102. The end closure is joined to the container wall, as shown in FIG. 2 by a peripheral flange 30, which is folded over the rim 32 of the can body to form a double seam in accordance with conventional practice. Other suitable joining means may be employed with the instant invention.

Figure 3:
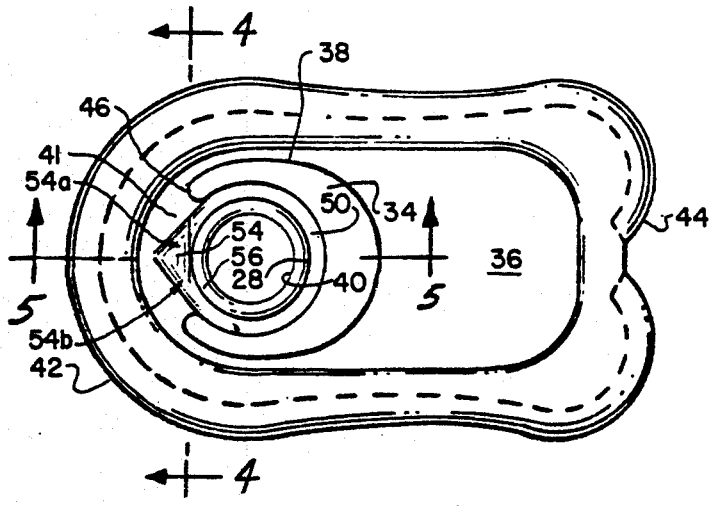
FIG. 3 is a top plan view of the tab.

The tab opening device 14, as best seen in FIG. 3, is a lever tab with a tongue 34 which is formed by lancing the tab web 36 in a U-shaped configuration 38, which terminates in reverse curls 46 to reduce the chance of web tear during the opening operation. The tab which is formed from 0.0185" tab stock has a curled rim. The resulting tab is sufficiently rigid to effect the panel opening without distorting the tab. The tab has a longitudinal axis with an outwardly disposed nose 42 at one end, and an inwardly disposed lift 44 at the other end. The tab tongue 34 has its root 41 proximate the tab nose lying between the extremities of the lancing. The tip of the tongue is inwardly directed and has an aperture 40 to receive the integral rivet 28. A band 50 surrounding the aperture is fully coined to a maximum depth to increase the bendability. The coining reduces the thickness of the tab stock from 0.0185" to between 0.0160" and 0.0100" say 0.0125". The 0.0185" tab stock is required to provide the necessary rigidity to the tab to permit it to exert an opening force on the end panel sufficient to effect rupture without allowing the tab to distort. While the resulting tab is rigid, without coining, the tab is susceptable to fracture in the area of the tongue root where a bend line is formed. By selectively reducing the thickness of the stock in the region of the bend line, it is possible to encourage the bending of the tab about one side of the tongue root. It has further been found that the sharpness of the bend at that side of the tongue root can be substantially increased by the selective coining of the web between the rivet and tab nose planes of graduated coining. More specifically, one side is coined to full depth and the other is not.

Figure 4:
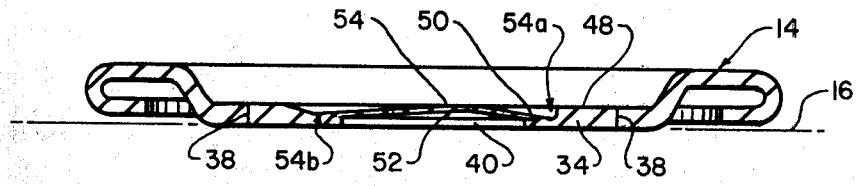
FIG. 4 is an enlarged sectional view of the tab taken along line 4—4 of FIG. 3.
Figure 6:
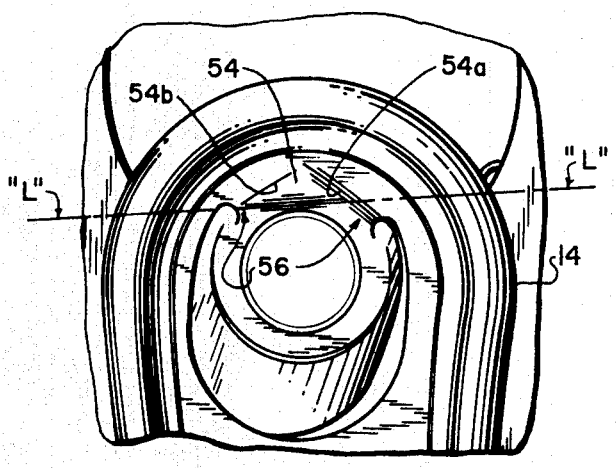
FIG. 6 is a partial plan view of the tab after being pivoted forward about a bend line "L" and in which it is crooked.

There is an outward transitional plane 52 which is isoceles triangular in shape and is called triangle configured plane 54 and joins the web proximate the tab nose with the coined band 50 as shown in FIG. 4 the coined side is **54*a* and the uncoined side has a gradual sloped as gusset 54*b*. The slope of the gusset should preferably be about 30° with respect to the plane 52, however, any fillet sufficient to strengthen the area will operate to encourage sharp bending near the rivet. The importance of the preceeding will be apparent in the explanation of operation. Fully coined segments 56, of the band, separate the outward and lateral transitional planes. These fully coined segments are substantially tangent to the reverse curl 46 portions of the lancing. The outward and coined segments 56 cooperate to urge the formation of the bend line of the tongue across the area of the fully coined segments 56. That is to say that, on the line of bending see FIG. 6 is crooked with respect to the base of the triangle configured plane 54 and the bend in segment 56 adjacent the gusseted side 54*b* is sharper due to the strengthening of the gusset 54*b***. In this way, the bendability of the tab can be increased to enable it to withstand in excess of 6 bend-rebend cycles on the average without complete fracture. Before the coined tab is staked to the central panel wall, the curling of the rim is completed and the aperture repunched to size. By extending the coining to completely encircle the rivet, it is possible to reduce the height of rivet required to effect joining.

Figure 7:
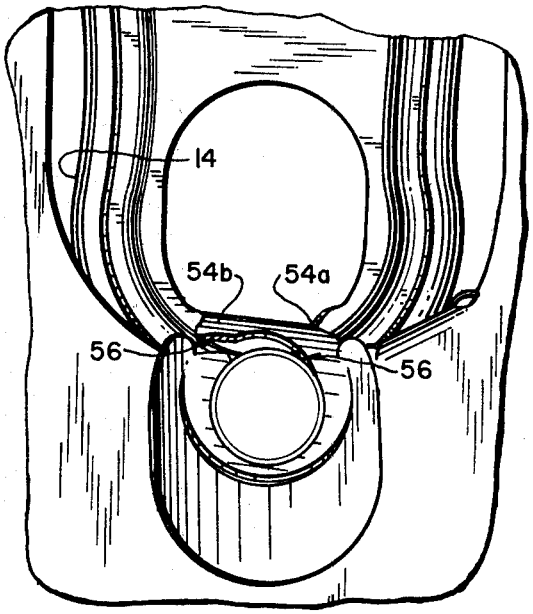
FIG. 7 is a partial plan view of the tab after yet another bend cycle showing the first fracture.

In operation, the lever tab is employed to open the end closure by inserting a fingernail or object under the curled rim of the tab lift end 44. As the lift end is raised, the tab nose bears against the pour panel proximate reenforcing bead 26 at the same time lifting the panel wall just outward of integral rivet 28 to put the metal of the score line proximate the rivet into shear. As the tab is pivoted forward to first rupture the score line and then to inwardly displace the displaceable panel, the tab tongue is distended in the region of the outward transitional plane 52, and a bend line is formed in the area 56 of maximum coining. FIG. 6 shows the tab after bending and rebending with line "L" in parallel to what would be the base of triangle configured plane 54. FIG. 7 shows the tab in a position of first partial fracture along the side near **54*b* where the initial bend was sharper. Because the tab bend line "L" has first fractured at one side the tab upon further bending and rebending will twist about 56 near 54*a*. The introduction of twisting is a different or new mode of stress which now initiated and so begins a new type of failure sequence. The selective coining at 54*a* and 54*b* operates to establish a two step failure wherein the first step consists of bending fracture (see FIG. 7**) and the second step consists of twisting until complete detachment.

Figure 5:
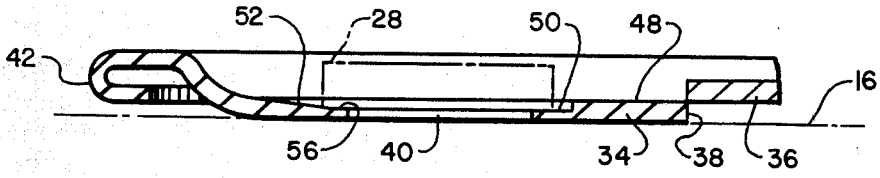
FIG. 5 is an enlarged fragmentary sectional view of the tab taken along line 5—5 of FIG. 3, and showing the rivet head in phantom.

In manufacture, the instant lever tab is formed from aluminum tab stock strip such as 5082-H19 or 5182-H19 of 0.0185" thickness. The strip is fed into a progressive tab die where it is first punched at appropriate intervals to provide rivet holes or apertures 40. The aperture tab stock is then panelled to form the tab web 36. The tab strip is subsequently sheared into discrete tab blanks. The tab blanks are fed individually to the next press station, where the edges of the blanks are wiped to form the rim of the tab as the first step in the tab rim curling process. The web of the tab blank is then lanced in a generally U-shaped configuration 38 with reverse curls 46 at the terminal portions of the lancing. The lancing operation will leave the tongue displaced out of the plane of the web. The portion of the tongue proximate the root is reinserted into the web plane whereas the portion of the tongue proximate the tip remains out of the web plane as best seen in FIG. 5. The displaced tongue tip is caused to undershoot the web, thereby canting the tab. In this way the completed tab when mounted on an end panel will be disposed with the lift and raised slightly to facilitate initiation of the opening sequence. The band surrounding the aperture as well as the transitional planes are coined. The band is fully coined to a residual thickness of 0.0160–0.0100" say 0.0125". The outward transitional plane 52 which is inclined to the upper surface 48 of the web at an angle of 6–7°, exhibits graduated coining ranging from no coining at the junction with the web surface 48 to full coining with a residual thickness of 0.0160"–0.0100" say 0.0125" at the junction with band 50. Before the coined tab is staked to the central panel wall, the curling of the rim is completed and the aperture is repunched to size.

Thus, it can be seen that the instant invention provides lever tab structure for an easy open end which is sufficiently rigid to permit effective operation, but with a bendable tongue which resists detachment and ensures retention. The concept here includes the idea of introducing a new form of stress in addition to bending. This is accomplished by asymmetry in the construction whether by means of an off center rivet scoring coining or any like modification which encourages breakage at one side first. Thus, a break occurs on one side during the bending phase after which the tab twists and tends to hold on longer. More specifically, the introduction of twist after bending facilitates the ability of the tab to resist detachment. Further, the tab structure is simple, requiring no separate retaining strip and lending itself to economical manufacture and recycling without the attendent problem of susceptability to corrosion.

It is believed that the foregoing general and detailed descriptions are explanatory of the present invention. It will be apparent that modification may be made without departing from the spirit and scope of the invention as defined by the appended claims.

What is claimed is:

1. An easy open closure for a container comprising:

(a) a central panel wall including a peripheral flange for joining said closure to said container and an integral rivet;

(b) a displaceable panel in said central panel wall disposed outwardly of said rivet and substantially defined by scoring; and (c) a lever tab with a tab nose and a tab lift and a central web disposed therebetween and wherein said tab web is lanced to form a tongue with said tongue joined to said central panel wall by means of said rivet and wherein a portion of said tongue is coined to a maximum depth on one side of said rivet and wherein other portions of said tongue substantially on the opposite side of said rivet being coining with graduated depth, whereby said tongue is urged to bend more sharply near said portion of graduated coining than said portion coined to a maximum depth when said tab is pivoted and breakage first occurs along said sharp bend causing thereafter twisting near said maximum coined portion.

2. The closure as recited in claim 1 wherein said coined areas of said web merge smoothly into said uncoined areas without sharp lines of delination between said coined and said uncoined areas except along at least one side of said tongue in a portion defined by the base of a triangle configured plane where there is a relatively sharp drop off from full thickness to an area of maximum coining on said one side of said rivet.

3. An easy open closure for a container comprising:

(a) a central panel wall including a peripheral flange for joining said closure to said container and an integral rivet;

(b) a displaceable panel in said central panel wall disposed outwardly of said rivet and defined by scoring; and (c) a lever tab with a longitudinal axis and a tab nose at one end thereof and a tab lift at the other end thereof and a central web disposed therebetween and wherein said tab web is lanced to form a tongue with its root proximate said tab nose and wherein its tip is apertured and staked to said central panel by said integral rivet and wherein a portion of said tongue is coined to a maximum depth as part of a band circumscribing said aperture and wherein a triangle configured transitional plane is disposed outward of said band and wherein said outward transitional plane has graduated coining along at least one side to urge said tongue to bend sharply on that side to first fracture at said line then twist near said area of maximum coining when said tab is pivoted forward to open said container.

4. The closure as recited in claim 3, wherein said outward transitional plane is inclined at an angle of between 5°–8° with respect to the upper surface of the web, and wherein said band being coined in a gradual fashion to said areas which are uncoined except along one side of said rivet adjacent said outward transitional plane.

5. An opening device for use with an easy opening container, comprising:

(a) a longitudinal lever tab with a curled rim;
(b) a nose disposed at one end of the said tab;
(c) a lift disposed at the end of said tab opposite said nose;
(d) a central web disposed within said rim and lying between said tab nose and said lift;
(e) a tongue formed in said web by a U-shaped lance with the root of said tongue proximate said tab nose and the tip of said tongue disposed toward said tab lift, and wherein said tongue tip is apertured to receive a rivet;
(f) a coined band circumscribing said aperture in said tongue;
(g) an outer asymmetrically coined transitional plane disposed between said tab nose and said aperture and coined in graduating depth to smoothly merge the upper surface of said web with said band; and
(h) a pair of laterally disposed segments about said aperture and coined in graduating depth to smoothly merge the upper surface of said web with said band and where said segments meet said transitional plane at one side of said aperture being coined to a maximum depth whereby said segments cooperate to provide a bend directing influence on said tongue when said tongue is subjected to a bending force as in the opening of a container for fracturing first along the other gradually coined one of said segments near said transitional plane and then twisting along the other.

6. The closure as recited in claim 3 wherein said outward transitional plane is inclined at an angle of $6\frac{1}{2}°$ with respect to the upper surface of said web.

7. The closure as recited in claim 3, wherein the residual thickness of said band after coining is between 0.0160" and 0.0100".

8. A method for defining the mode of failure for an opening device for use with an easy opening container having a longitudinal lever including a nose at one end, a lift portion at the other with an attachment web therebetween, said web including a selectively coined portion about a rivet for holding said tab to said container including the following steps:

bending along a line transversed to said rivet normal to a line from said nose to said lift portion wherein a portion of said line being weaker to define a first area of breakage, breaking along said weaken line and holding along said remaining portion, twisting about said remaining portion during further bending thereby introducing another form of stress.

* * * * *